US005533621A

United States Patent [19]

Schoal, Jr.

[11] Patent Number: 5,533,621

[45] Date of Patent: Jul. 9, 1996

[54] CONTAINER FOR A ROLL OF WOUND MATERIAL

[76] Inventor: Edward Schoal, Jr., 329 Summit Ave., Westville, N.J. 08093

[21] Appl. No.: 439,161

[22] Filed: May 11, 1995

[51] Int. Cl.[6] ..... A47K 10/32

[52] U.S. Cl. ..... 206/409; 206/812; 206/818

[58] Field of Search ..... 206/389, 390, 206/409, 411, 412, 494, 555, 812, 813, 818

[56] References Cited

U.S. PATENT DOCUMENTS

| | | | |
|---|---|---|---|
| 2,097,858 | 11/1937 | Herz . | |
| 3,718,251 | 2/1973 | Barnett . | |
| 3,795,355 | 3/1974 | Gerstein | 206/494 X |
| 4,118,616 | 10/1978 | Wittkamp et al. | 206/389 |
| 4,171,047 | 10/1979 | Doyle et al. | 206/409 X |
| 4,274,573 | 6/1981 | Finkelstein . | |
| 4,535,912 | 8/1985 | Bonk | 206/409 X |
| 4,583,642 | 4/1986 | Blythe et al. . | |
| 4,645,108 | 2/1987 | Gavin et al. . | |
| 4,989,734 | 2/1991 | Mode et al. | 206/818 X |
| 5,205,454 | 4/1993 | Schutz et al. . | |
| 5,320,772 | 6/1994 | Tricca | 206/812 X |

*Primary Examiner*—Jacob K. Ackun

*Attorney, Agent, or Firm*—Norman E. Lehrer; Jeffrey S. Ginsberg

[57] ABSTRACT

A container for housing a cylindrical roll of wound material and for facilitating the dispensing of an individual sheet from the roll includes a main body that has a bottom, a front wall, a rear wall, opposing end walls and an open top. The front wall, rear wall, end walls and the bottom define an open space for receiving a cylindrical roll of wound material therein. A lid with an elongated slot formed therethrough is hingedly connected to the rear wall and is adapted to cover the top of the main body. A cover is included that is adapted to cover the lid and the top of the container. The cover is sized to partially frictionally engage the outer surfaces of the front, rear and end walls. The container preferably includes fasteners for securing the bottom of the same to a support structure.

9 Claims, 2 Drawing Sheets

CONTAINER FOR A ROLL OF WOUND MATERIAL

BACKGROUND OF THE INVENTION

The present invention is directed toward a container for a roll of wound material and, more particularly, to such a container that is adapted to facilitate the individual dispensing of a severable sheet of material from a cylindrical roll.

Presently, there are many existing containers for facilitating the dispensing of individual sheets from a cylindrical roll of material housed therein. U.S. Pat. No. 4,274,573, for example, discloses a dispenser for material that is wound into a cylindrical roll. In use, the end walls have circular openings formed therethrough for allowing a roll of material to be inserted therein. Further, there is a slot in one of the side walls for allowing an individual sheet to extend therefrom. A drawback with this dispenser lies in the fact that there are no means provided for closing the cylindrical openings and the slot when the dispenser is not in use. Accordingly, this dispenser would not be useful for housing materials, such as fabric softener sheets, that are subject to drying out when exposed to the air for an extended period of time.

U.S. Pat. Nos. 4,583,642 and 5,205,454 also disclose dispensers for interconnected sheets of materials that are formed in cylindrical rolls. Once again, these devices have openings that are exposed whether or not the device is in use. Accordingly, if the material to be housed is susceptible to drying, these dispensers would be ineffective.

SUMMARY OF THE INVENTION

The present invention is designed to overcome the deficiencies of the prior art discussed above. It is an object of this invention to house a cylindrical roll of material in a substantially airtight container.

It is a further object to provide such a container that can individually dispense a severable sheet of material from the cylindrical roll.

It is yet another object of the invention to provide such a container that can be securely attached to a supporting structure.

In accordance with the illustrative embodiments, demonstrating features and advantages of the present invention, there is provided container for housing a cylindrical roll of material therein and for individually dispensing a sheet from the roll. The container includes a main body that has a bottom, a pair of opposing side walls, a pair of opposing end walls and an open top. The side walls, end walls and the bottom define an open space for housing a roll of wound material therein. The container has a lid with an elongated slot formed therethrough. The lid is hingedly connected to one of the side walls and is adapted to releasably engage the other side wall. The container preferably has a cover which is hingedly connected to one of the side walls and is adapted to releasably cover the lid and the top of the container.

Other objects, features and advantages will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
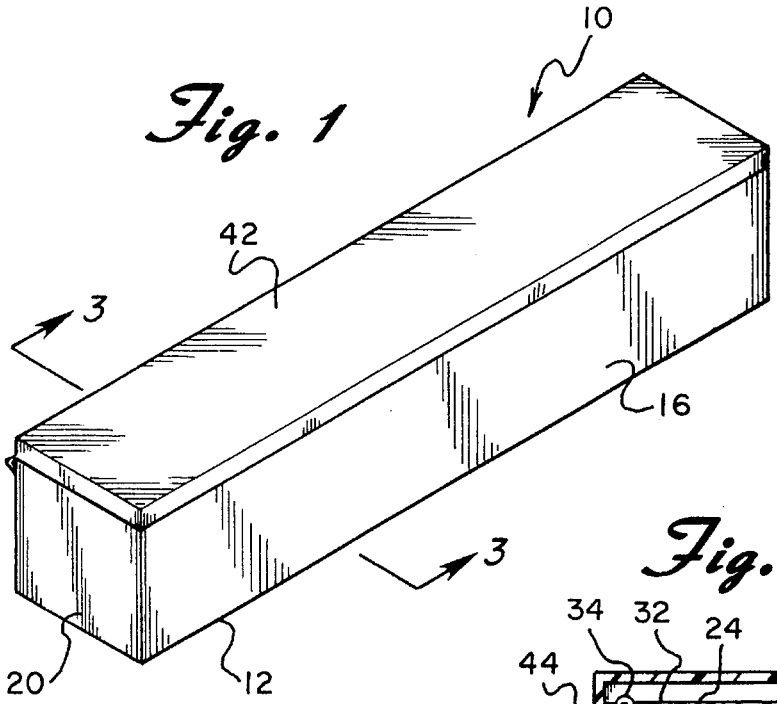
FIG. 1 is a perspective view of the container of the present invention.

Referring now to the drawings in detail wherein like reference numerals have been used throughout the various figures to designate like elements, there is shown in the figures a container for housing a cylindrical roll of wound material therein constructed in accordance with the principles of the present invention and designated generally as 10.

Figure 3:
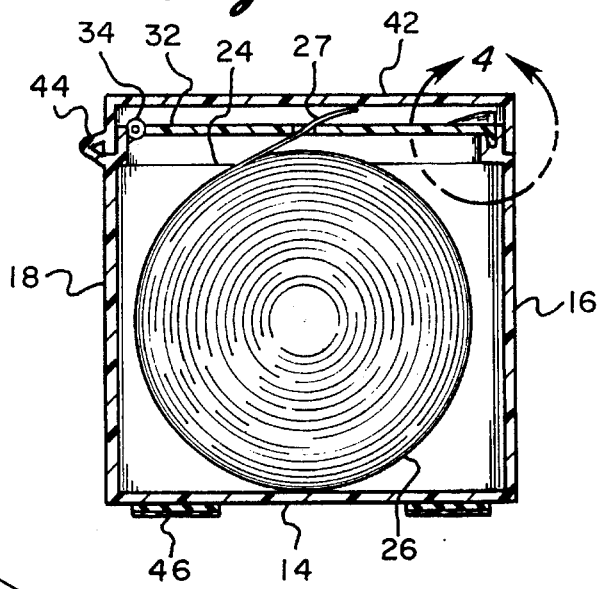
FIG. 3 is a cross-sectional view of the container showing a roll of wound material housed therein.
Figure 2:
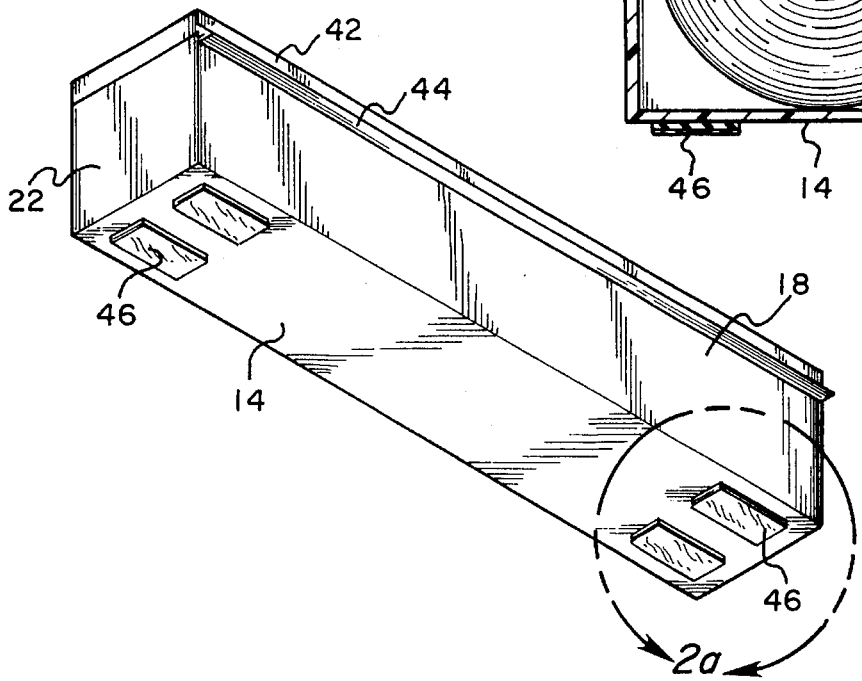
FIG. 2 is a bottom and side perspective view of the container showing magnetic strips secured to the bottom thereof.
Figure 6:
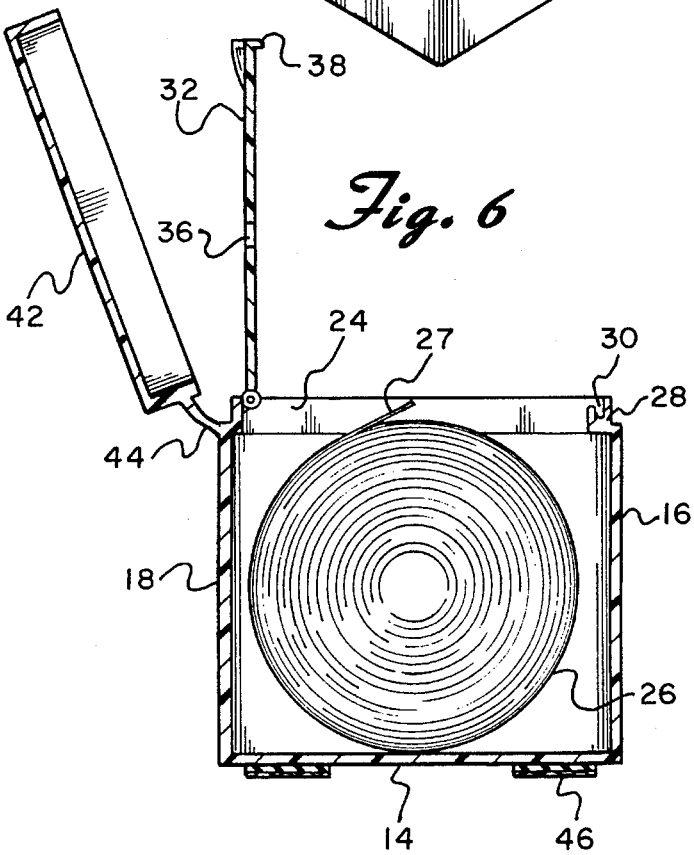
FIG. 6 is a cross-sectional view of the container showing the cover and lid in the open condition.
Figure 4:
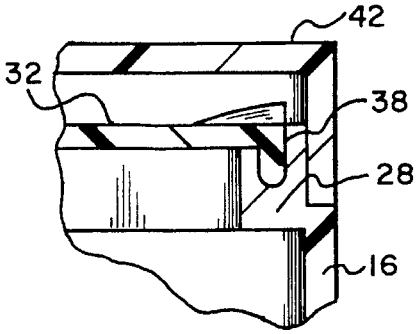
FIG. 4 is a partial cross-sectional view taken along line 4 of FIG. 3.

The container 10 includes a main body 12 that has a bottom 14, front wall 16, rear wall 18, a pair of opposing end walls 20 and 22 and an open top 24 (see FIGS. 1–3). The main body is preferably comprised of polyvinyl chloride or other similar polymeric material. The bottom, front wall, rear wall and the end walls define an open space for containing a roll of wound material 26 therein as shown in FIGS. 3 and 6. The material 26 is preferably a plurality of severable fabric softener sheets 27 wound together in a cylindrical roll. It should be noted, however, that the roll can be comprised of a plurality of other severable sheets such as paper towels. Individual sheets are typically severed from the roll via a plurality of perforations formed along the length thereof.

Extending upwardly from the front and rear walls 16 and 18, respectively, and the end walls 20 and 22 is a rectangular lip 28 defined by a plurality of portions. The portion of the lip 28 that extends upwardly from front wall 16 has a groove 30 formed therethrough (see FIG. 6). The groove preferably extends the length of the front wall 16.

Referring to FIGS. 3 and 6, a lid 32 is connected to the portion of the lip 28 that extends upwardly from the rear wall 18 by means of a hinge 34. Formed in the center of the lid 32 is an elongated longitudinal slot 36. A projection 38 extends downwardly from the side of the lid 32 opposite the hinge 34. The projection 38 is sized to be frictionally fitted into the groove 30 of lip 28. It should be noted that the lid 32 can be releasably secured over the top 24 of the main body in other ways. For example, the projection 38 could be designed to be secured to the portion of the lip 28 that extends upwardly from the front wall 16 by means of a snap fastener. In the preferred embodiment, the lid 32 includes a raised portion 40 that facilitates the manual releasing of the projection 38 from the longitudinal groove 30 as more fully described below.

A cover 42 is connected to the upper portion of rear wall 18 by means of a living hinge 44. The cover 42 is adapted to be positioned over the lid 32 and to frictionally engage the outer perimeter of the lip 28. When the cover is in the closed position, it provides an essentially airtight seal for the container 10.

Figure 2A:
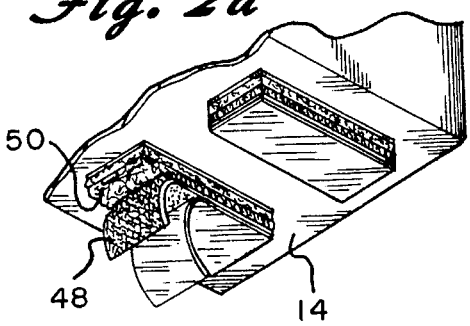
FIG. 2*a* is a partial view of the bottom of the container but showing Velcro hook and loop type fasteners secured thereto.
Figure 5:
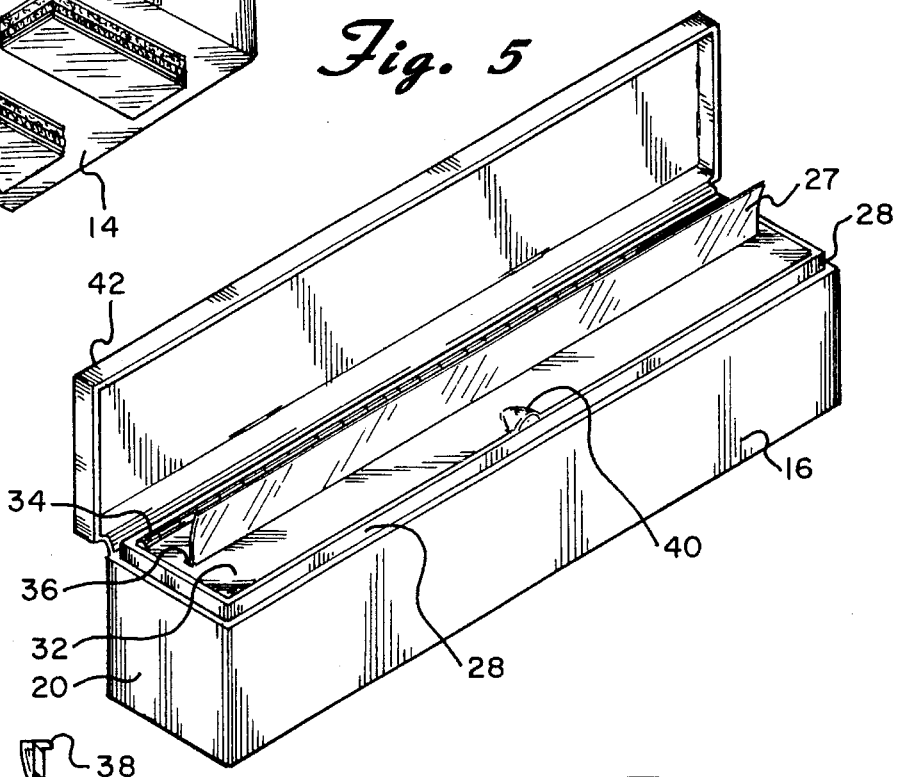
FIG. 5 is a top side perspective view of the container showing the cover in the open condition.

In the preferred embodiment, the bottom 14 of the container 12 has a plurality of magnetic strips 46 secured to the undersurface thereof as shown in FIG. 2. The magnetic strips allow the container to be secured to a support structure made of a ferromagnetic material. However, the container can be mounted to a support structure in a number of other ways. For example, a plurality of Velcro hook and loop type fasteners 48 and 50, respectively, can be secured to the bottom 14 of the container in lieu of the magnetic strips (see FIG. 2*a*). The hook type fasteners are adapted to be secured to the support structure that the container is to be mounted to by means of an adhesive.

To facilitate an understanding of the principles associated with the foregoing apparatus, its operation will now be briefly described. The container is preferably secured atop a ferromagnetic support structure such as a clothes dryer by positioning the magnetic strips 46 atop the structure. A cylindrical roll of wound material 26 is placed in the container through the top 24 of the same (see FIG. 6). Thereafter, the lid 32 is positioned so that the projection 38 frictionally engages the groove 30 in the portion of the lip 28 that extends upwardly from the front wall 16. The upper portion of a severable sheet 27 from the roll of wound material 26 is positioned through the slot 36. When the user of the container 10 needs to remove a sheet 27 from the cylindrical roll 26, he or she grasps the sheet and pulls the same from the slot 36 until the perforations on the sheet are positioned approximately adjacent to the perimeter of the slot 36. The user then tears the sheet 27 along the perimeter of the slot 36 to separate the sheet from the roll 26.

Once the desired number of sheets are removed from the container 10, the cover is positioned over the lid so that it frictionally engages the outer perimeter of the lip 28. The cover effectively prevents air from entering the slot 36 when the container is not being used. This is particularly advantageous since the roll of material 26 may be comprised of a plurality of fabric softener sheets, which are susceptible to drying if exposed to air for a prolonged period of time.

When the last sheet 27 is removed from the roll 26, a fresh roll is inserted into the container. In order to insert the new roll, the lid 32 must first be opened. This is accomplished by applying upward force to the raised portion 40 on the lid 32 so that the projection 38 is removed from the groove 30 and the lid can swing about hinge 36. A new roll can then be inserted into the container through the open top end 24.

The present invention may be embodied in other specific forms without departing from the spirit or essential attributes thereof and accordingly reference should be made to the appended claims rather than to the foregoing specification as indicating the scope of the invention.

What is claimed is:

1. A container for housing a roll of wound material therein and for facilitating the dispensing of an individual sheet from the roll comprising:

a main rectangular body having a bottom, a front wall, a rear wall, a pair of opposing end walls and an open top, said front wall, rear wall, end walls and said bottom defining an open space for receiving a roll of wound material therein;

a lip extending upwardly from said front, rear and end walls;

a lid means having a longitudinal slot formed therethrough, said lid means being hingedly connected to said rear wall and being adapted to releasably engage said front wall, and cover means hingedly connected to said outer surface of one of said front and rear walls along substantially the entire length thereof for covering said top of said main body and said lid means, said cover means being sized to frictionally engage the outer surface of said upwardly extending lip.

2. The container of claim 1 further including fastening means for securing said bottom of said main body to a support structure.

3. The container of claim 1 wherein said fastening means includes at least one magnetic strip secured to said bottom of said main body.

4. The container of claim 1 wherein said fastening means includes a plurality of two part hook and loop type fasteners, one of said parts being secured to said bottom of said main body and the other of said parts being adapted to be secured to a support structure.

5. The container of claim 4 further including fastening means for securing said bottom of said main body to a support structure.

6. The container of claim 5 wherein said fastening means includes at least one magnetic strip secured to said bottom of said main body.

7. The container of claim 5 wherein said fastening means includes a plurality of two part hook and loop type fasteners, one of said parts being secured to said bottom of said main body and the other of said parts being adapted to be secured to a support structure.

8. A container for housing a roll of wound material therein and for facilitating the dispensing of an individual sheet from the roll comprising:

a main body having a bottom, a front wall, a rear wall, a pair of opposing end walls and an open top, said front wall, rear wall, end walls and said bottom defining an open space for receiving a roll of wound material therein;

a plurality of lip portions, each of said lip portions extending upwardly from a corresponding one of said front, rear and end walls, said lip portion extending upwardly from said front wall having a groove formed therein;

a lid means having a longitudinal slot formed therethrough, said lid means being hingedly connected to said rear wall and including means for releasably engaging said groove in said lip portion, and cover means hingedly connected to said container for covering said top of said main body and said lid means, said cover means being sized to frictionally engage the outer surfaces of said lip portions.

9. A container for housing a roll of wound material therein and for facilitating the dispensing of an individual sheet from the roll comprising:

a main body having a bottom, a front wall, a rear wall, a pair of opposing end walls and an open top, said front wall, rear wall, end walls and said bottom defining an open space for receiving a roll of wound material therein;

a plurality of lip portions, each of said lip portions extending upwardly from a corresponding one of said front, rear and end walls, said lip portion extending upwardly from said front wall having a groove formed therein, and a lid means having a longitudinal slot formed therethrough, said lid means being hingedly connected to said rear wall and including a projection extending downwardly from a side thereof for releasably engaging said groove in said lip portion.

* * * * *